US008511131B2

(12) United States Patent
Latoria

(10) Patent No.: US 8,511,131 B2
(45) Date of Patent: Aug. 20, 2013

(54) CABLE BENDER

(71) Applicant: Huskie Tools, Inc., Glendale Heights, IL (US)

(72) Inventor: Joseph S. Latoria, West Chicago, IL (US)

(73) Assignee: Huskie Tools, Inc., Glendale Heights, IL (US)

( * ) Notice: Subject to any disclaimer, the term of this patent is extended or adjusted under 35 U.S.C. 154(b) by 0 days.

(21) Appl. No.: 13/625,030

(22) Filed: Sep. 24, 2012

(65) Prior Publication Data

US 2013/0081440 A1 Apr. 4, 2013

Related U.S. Application Data

(60) Provisional application No. 61/542,435, filed on Oct. 3, 2011.

(51) Int. Cl.
*B21D 7/04* (2006.01)

(52) U.S. Cl.
USPC ..... 72/389.2; 72/389.1; 72/389.6; 72/390.3

(58) Field of Classification Search
USPC ..... 72/388, 389.1, 389.2, 389.6, 389.7, 72/389.8, 390.3, 458, 459
See application file for complete search history.

(56) References Cited

U.S. PATENT DOCUMENTS

| | | | | | |
|---|---|---|---|---|---|
| 2,100,961 | A | * | 11/1937 | Jones et al. | 72/390.3 |
| 3,415,104 | A | * | 12/1968 | Conklin, Jr. | 72/400 |
| 3,584,493 | A | * | 6/1971 | Crees | 72/321 |
| 3,924,438 | A | * | 12/1975 | Linquist et al. | 72/388 |
| 4,569,219 | A | * | 2/1986 | Threlkel et al. | 72/381 |
| 7,900,495 | B2 | * | 3/2011 | Latoria | 72/458 |

* cited by examiner

*Primary Examiner* — David B Jones
(74) *Attorney, Agent, or Firm* — Wood Phillips Katz Clark & Mortimer

(57) ABSTRACT

A cable bending tool comprises a drive housing including a powered drive element. A jaw assembly comprises first and second jaws hingedly connected to one another. The drive element is selectively operated to cause the first and second jaws to move between a neutral and an actuated position. A bending shoe is secured to a distal end of the first jaw. An arm with opposite rollers is secured to a distal end of the second jaw and extends transversely to a path of movement of the jaws. The rollers support a cable with the bending shoe on an opposite side of the cable.

20 Claims, 7 Drawing Sheets

CABLE BENDER

CROSS-REFERENCE TO RELATED APPLICATIONS

This application claims priority of provisional application No. 61/542,435 filed Oct. 3, 2011.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to a cable bender and, more particularly, to a battery powered cable bending tool.

BACKGROUND

Numerous tools are available for bending relatively small diameter cables. As cable sizes increase, such as high voltage power cables having a diameter on the order of 1", bending the cable without damage becomes more difficult. Caution must be used so as not to bend the cable in a radius too tight that it may damage insulation or conductors. Typically, a bend radius should be approximately 12 times the diameter of the cable itself. Thus, a 1" diameter cable should have a 12" radius bend. Currently, manually operated tools similar to conduit benders are used to bend larger cables. However, these tools require use of a long pole to turn the bending shoe. Such a long pole requires ample space be provided. Often, there is limited space available in order to access the cable and achieve the proper bend.

The present application is directed to improvements in cable bending apparatus.

SUMMARY

In accordance with the invention, there is provided a portable cable bending tool, such as a battery powered cable bending tool.

There is disclosed in accordance with one aspect a powered cable bending tool comprising a portable drive housing including a handle and having a powered drive element. A jaw assembly is secured to the housing and comprises first and second jaws hingedly connected to one another. The drive element is selectively operated to cause the first and second jaws to move between a neutral and an actuated position. A bending shoe is secured to a distal end of the first jaw. An arm is secured to a distal end of the second jaw and extends transversely to a path of movement of the jaws. First and second rollers are operatively secured to the arm at opposite sides of the second jaw. The rollers support a cable in use, with the bending shoe on an opposite side of the cable. In the neutral position the bending shoe is spaced a first distance from a line formed between the rollers and in the actuated position the bending shoe is spaced a second distance, less than the first distance, from the line formed between the rollers to bend the cable.

There is disclosed in accordance with another aspect, a battery powered cable bending tool comprising a portable drive housing including a handle selectively receiving a removable battery and enclosing an electromechanical drive having a powered drive element extending from the housing. A jaw assembly is secured to the housing proximate the drive element and comprises first and second jaws hingedly connected to one another and having near ends engaging the drive element. The drive element is selectively operated to cause distal ends of the first and second jaws to move between a neutral and an actuated position. A bending shoe is secured to the distal end of the first jaw. An arm is secured to the distal end of the second jaw and extends transversely to a path of movement of the jaws. First and second rollers are operatively secured to the arm on opposite sides of the second jaw. The rollers support a cable, in use, with the bending shoe on an opposite side of the cable. In the neutral position, the bending shoe is spaced a first distance from a line formed between the rollers and in the actuated position the bending shoe is spaced a second distance, less than the first distance, from the line formed between the rollers to bend the cable.

It is a feature that opposite legs extend from a distal end of the housing and the power drive element comprises a ram movable in a path between the legs. The ram may support rollers.

It is another feature that the housing selectively receives a battery for powering the power drive element.

It is a further feature that the jaw assembly is positioned between the legs and a lug passes through openings in distal ends of the legs and a hinge opening of the jaw assembly to secure the jaw assembly to the housing.

It is another feature that the bending shoe comprises a concave plate.

It is still another feature that the rollers have threaded shafts for selectively securing the rollers to the arm. The arm may include a plurality of spaced openings on each of the opposite sides of the second jaw for selectively receiving the rollers according to a size and bend radius of a cable to be bent.

It is an additional feature that a handle is secured to a top edge of the first jaw.

It is yet another feature that the jaw assembly comprises a spring operatively connected to the first and the second jaws to bias the jaw assembly to the neutral position.

Other features and advantages will be apparent from a review of the entire specification, including the appended claims and drawings.

DETAILED DESCRIPTION

Figure 1:
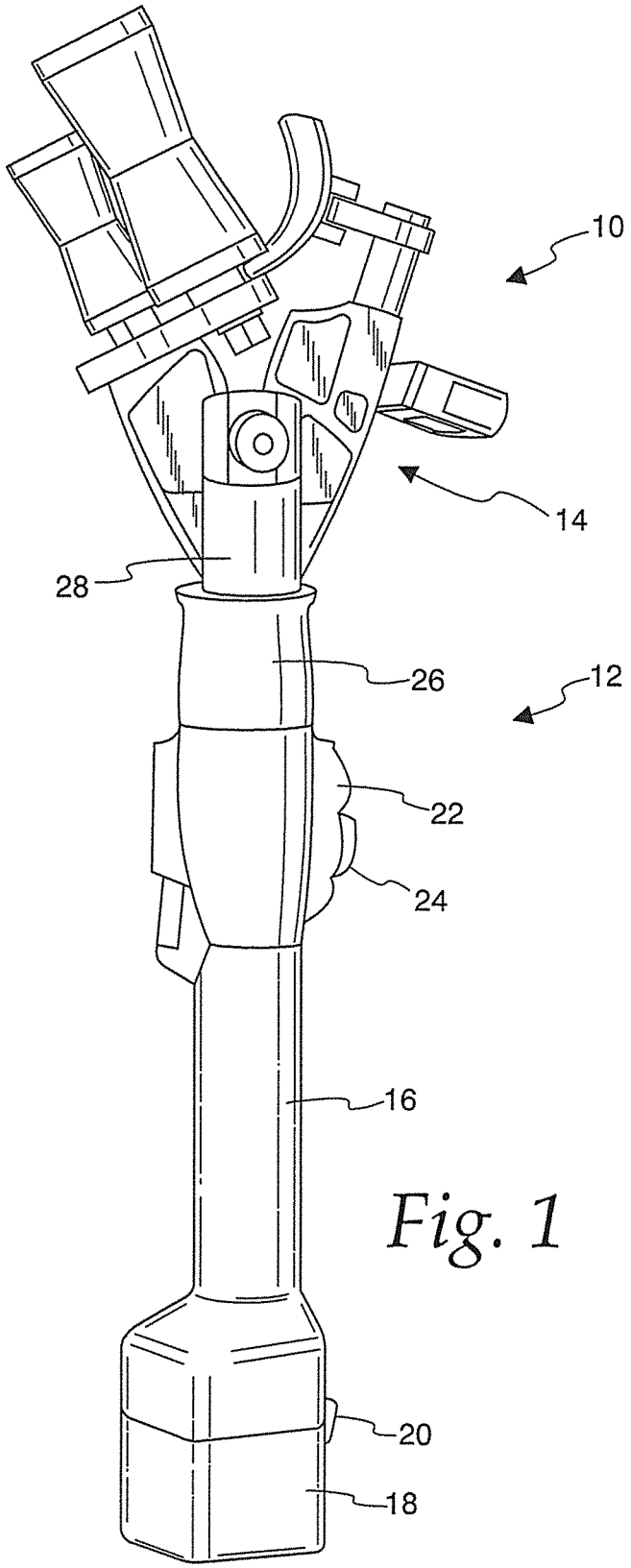
FIG. 1 is a perspective view of the powered cable bending tool.

Referring initially to FIG. 1, a battery powered, portable cable bending tool 10 is illustrated. The cable bending tool 10 comprises a portable drive housing 12 and a tool head 14. The portable drive housing 12 comprises a tubular housing section 16 selectively receiving a rechargeable battery 18 secured with a locking button 20. An opposite end of the tubular housing section 16 is connected to a control section 22 having a three position switch 24. A collar 26 extends from a distal end of the control section 22. First and second legs 28 and 30, see also FIG. 6, extend from a distal end of the collar 26 with a space 32 therebetween. The first leg 28 includes an opening (not shown), receiving a pin 34. The second leg 30 includes an opening 36 in line with the pin 34 to selectively receive the same.

Figure 6:
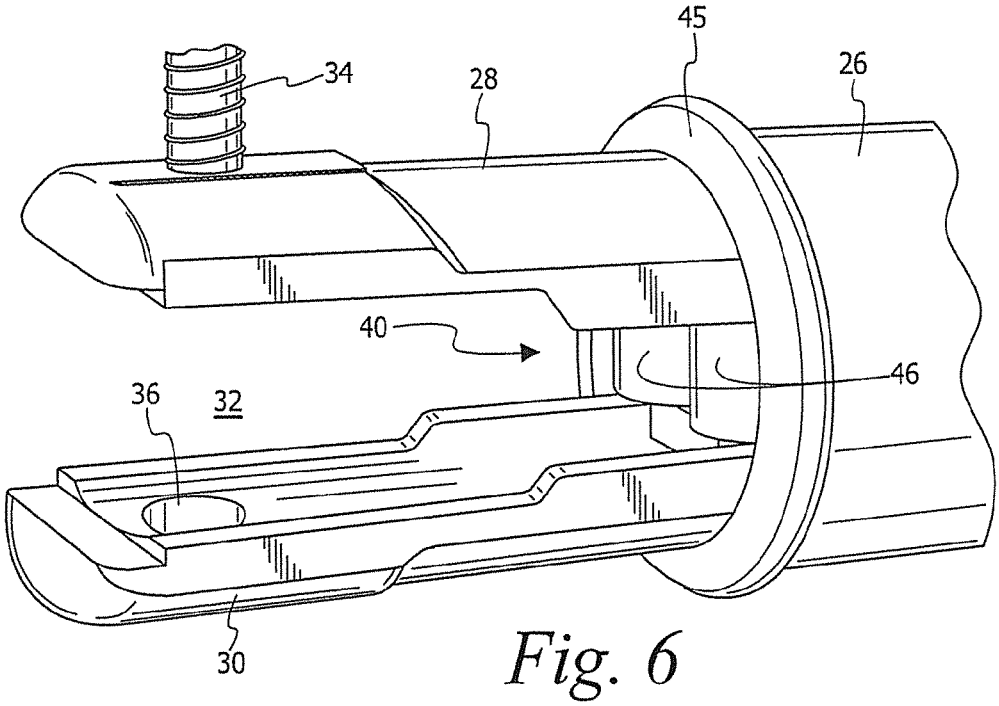
FIG. 6 is a partial perspective view of a distal end of a portable drive housing of the cable bending tool shown with a drive element in a neutral position.
Figure 7:
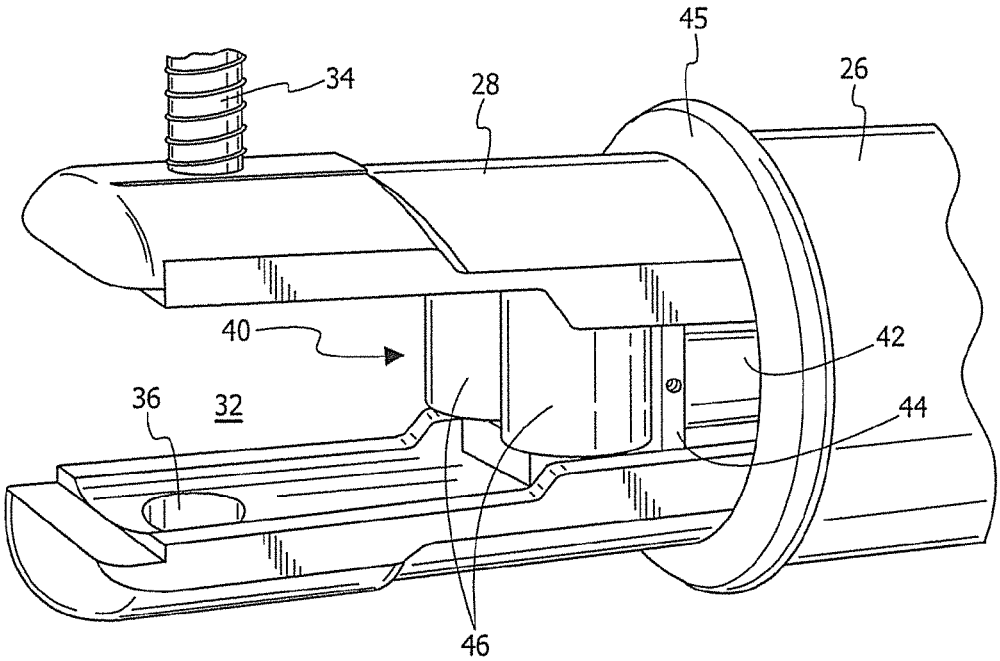
FIG. 7 is a partial perspective view of the distal end of the portable drive housing shown with the drive element in an actuated position.

The portable drive housing 12 encloses a conventional electromechanical drive having a powered drive element 40 extending from a distal end of the collar 26, see FIG. 7. The drive element 40 comprises a ram 42 carrying a bracket 44 having a pair of rollers 46 suitably mounted thereon. As is conventional, the electromechanical drive is operated using power from the battery 18 responsive to position of the switch 24. The switch 24 can be operated to move the drive element 40 within the space 32 between a neutral position shown in FIG. 6 where the drive element 40 is approximately even with an upper flange 45 at a distal end of the collar 26 and an actuated position shown in FIG. 7 where the drive element extends a select distance into the space 32.

The particular form of the electromechanical drive, as well as the particular configuration of the portable drive housing 12, does not itself form part of the invention. The drive housing 12 can take other known shapes and use other drive mechanisms in order to provide the linear movement of the drive element 40, as will be apparent.

Figures 3, 3A:
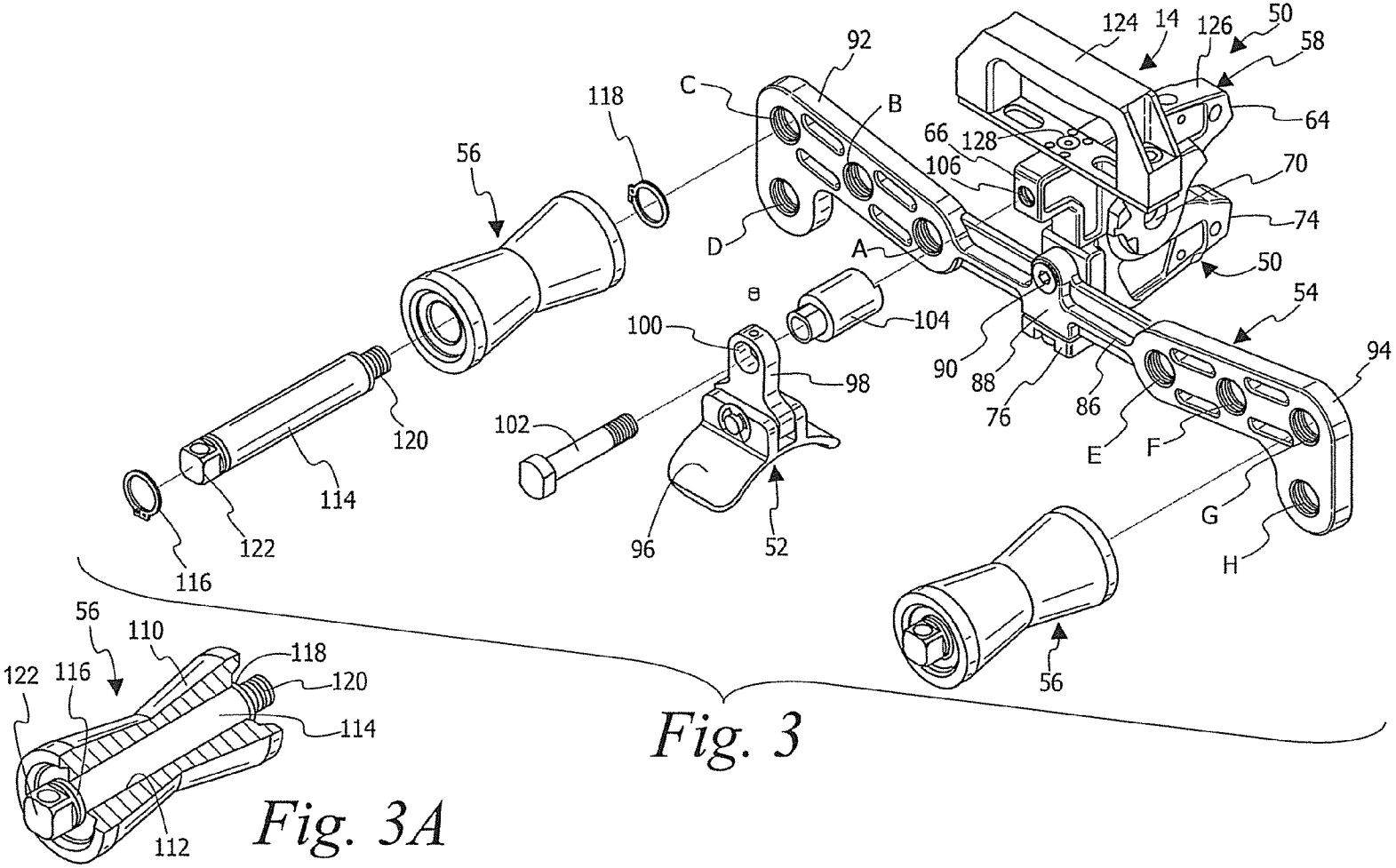
FIG. 3 is an exploded view of the tool head of FIG. 2.
FIG. 3A is a partial cut-away view of a roller of the tool head of FIG. 3.

Referring also to FIG. 3, the tool head 14 comprises a jaw assembly 50, a bending shoe 52, an arm 54 and first and second rollers 56. Each of the rollers 56 is of identical construction.

Figure 4:
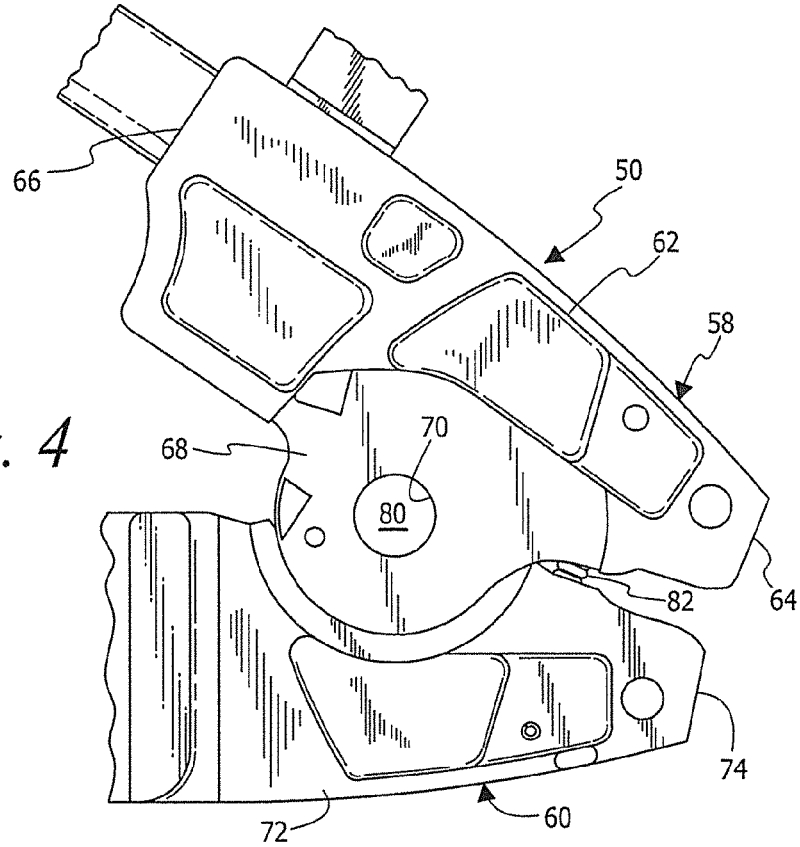
FIG. 4 is a partial, side view of a jaw assembly of the tool head in a neutral position.
Figure 5:
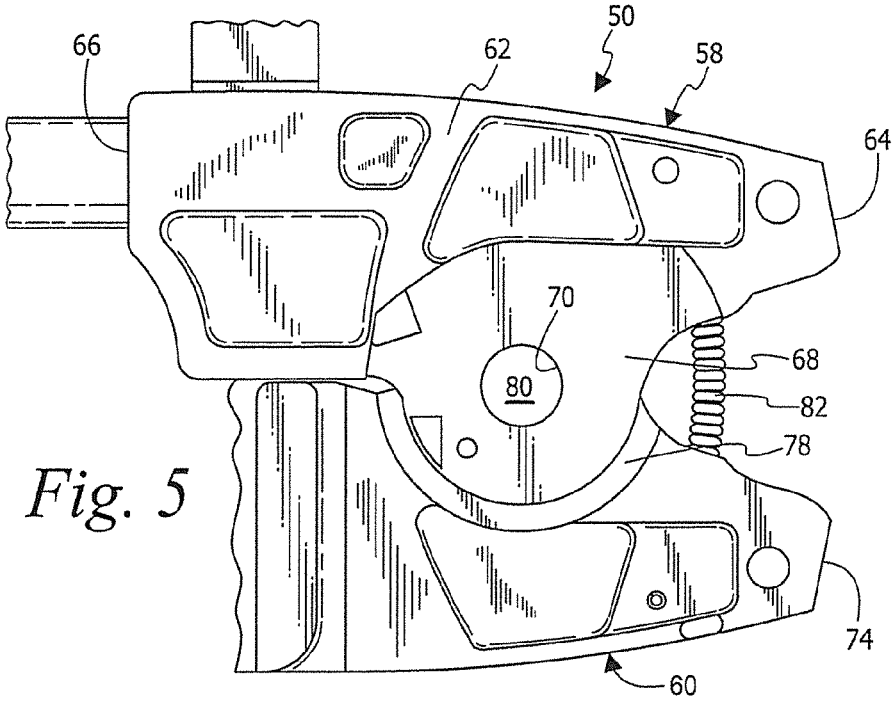
FIG. 5 is a partial, side view of the jaw assembly of the tool head in the actuated position.

Referring also to FIG. 4, the jaw assembly 50 comprises a first jaw 58 and a second jaw 60. The first jaw 58 comprises a formed body 62 having a near end 64 and a distal end 66. A circular plate 68 extends downwardly between the near end 64 and distal end 66. The circular plate 68 includes a circular opening 70. The second jaw 60 comprises a formed body 72 having a near end 74 and a distal end 76, see FIG. 3. A circular plate 78 extends upwardly between the near end 74 and distal end 76 and includes a central opening (not identified), in line and similar to the central opening 70. The circular plates 68 and 78 are hingedly connected to one another at 80 which defines a hinge opening. A spring 82 is secured in any known manner to the first jaw 58 and the second jaw 60 adjacent the respective near ends 64 and 74 to bias the jaws to a neutral position, shown in FIG. 4. The jaw assembly 50 can be selectively operated, as discussed below, to move the jaws 58 and 60 relatively about the hinge opening 80 to the actuated position, shown in FIG. 5.

Referring again to FIG. 3, the arm 54 comprises a formed, elongate bar 86 having a center section 88 secured using a fastener 90 to the second jaw distal end 76. L-shaped brackets 92 and 94, which are mirrors of one another, extend outwardly from the center section 88 and each includes four threaded openings, labelled A, B, C and D in the first bracket 92, and E, F, G and H in the second bracket 94. Each of the threaded openings A-H is adapted to selectively receive the rollers 56.

The bending shoe 52 comprises a concave plate 96 pivotally connected to a plate 98. The plate 98 includes a through opening 100. A lug 102 is selectively inserted through the through opening 100 and a spacer 104 into an opening 106 of the first jaw distal end 66. The bending shoe 52 faces downwardly, as shown.

Referring also to FIG. 3A, each of the rollers 56 comprises an hour glass shaped roller body 110 having a cylindrical through opening 112. An elongate shaft 114 is positioned in the through opening 112. Retaining rings 116 and 118 are secured to opposite ends of the shaft 114 to retain the roller body 110 thereon while allowing the body 110 to rotate about the shaft 114. The shaft 114 includes a threaded near end 120 and a square shaped opposite end 122. The threaded near end 120 is selectively threaded into any one of the threaded openings A-H using a suitable tool on the squared opposite end 122, as will be apparent. A handle 124 is secured to an upper edge 126 of the first jaw 58, using fasteners 128.

With the jaw assembly 50 in the neutral position, as shown in FIG. 4, and the drive element 40 likewise in the neutral position, as shown in FIG. 6, the tool head 14 can be mounted to the portable drive housing 12 by inserting the jaw assembly 50 into the space 32. The hinge opening 80 is aligned with the pin 34 and leg opening 36. The pin 34 is then inserted through the hinge opening 80 into the opposite leg opening 36 and locked in place. The jaw distal ends 64 and 74 are slightly angled, as shown in FIG. 4, and rest on the rollers 46. The assembled structure is shown in FIG. 8.

Figure 2:
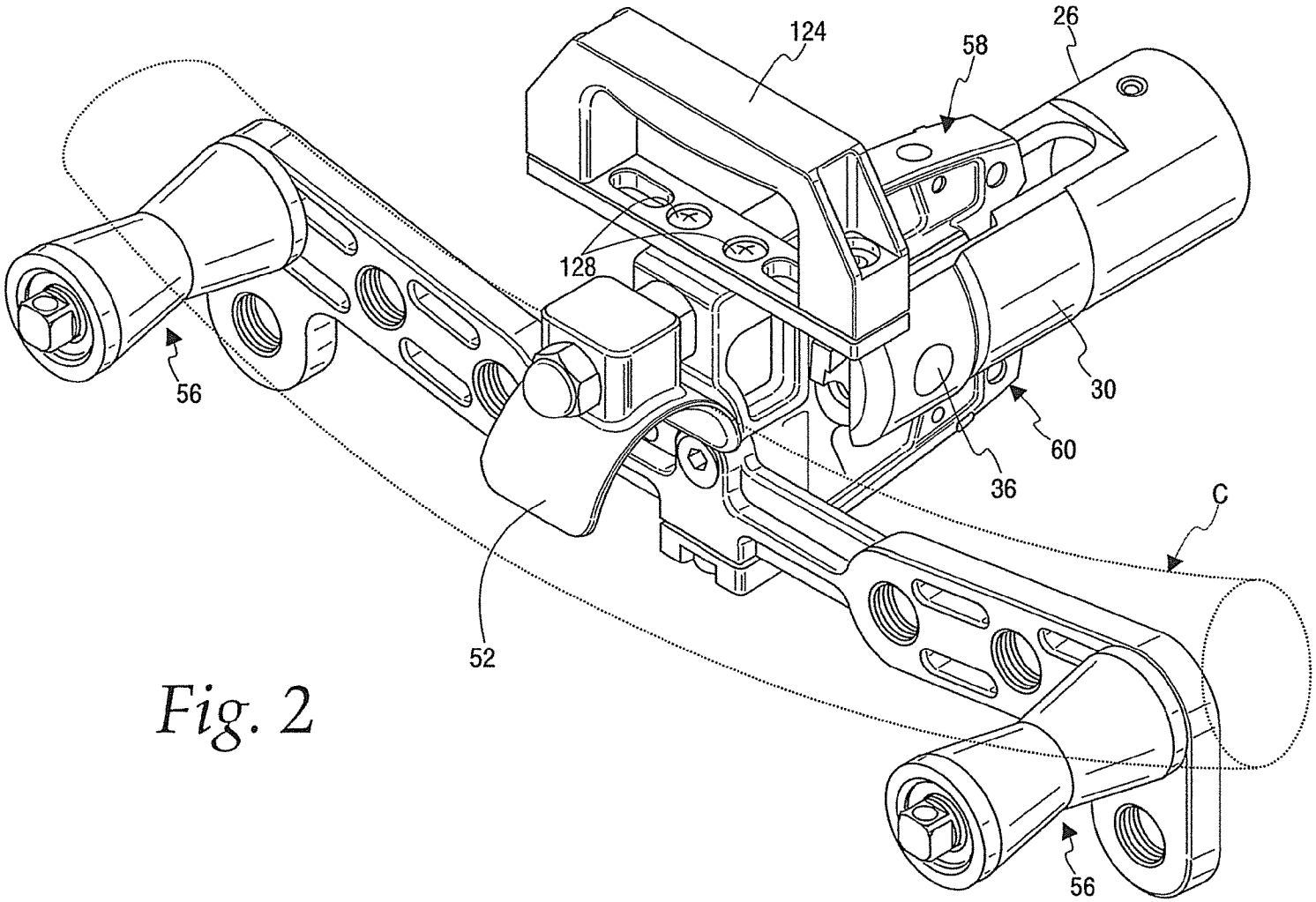
FIG. 2 is a perspective view of a tool head of the cable bending tool of FIG. 1 shown acting on a cable.
Figure 8:
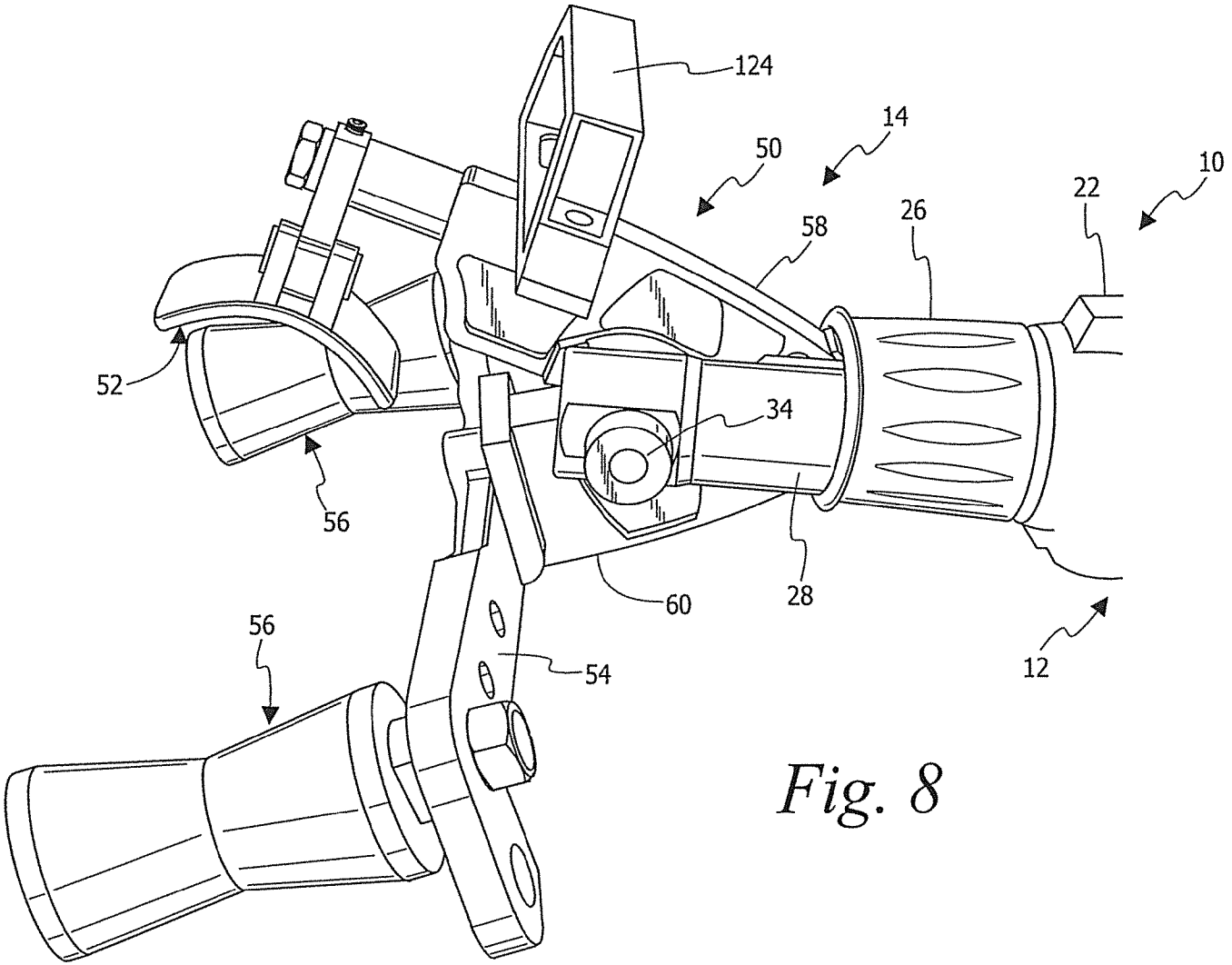
FIG. 8 is a partial perspective view of the cable bending tool with the jaw assembly in the neutral position.
Figure 9:
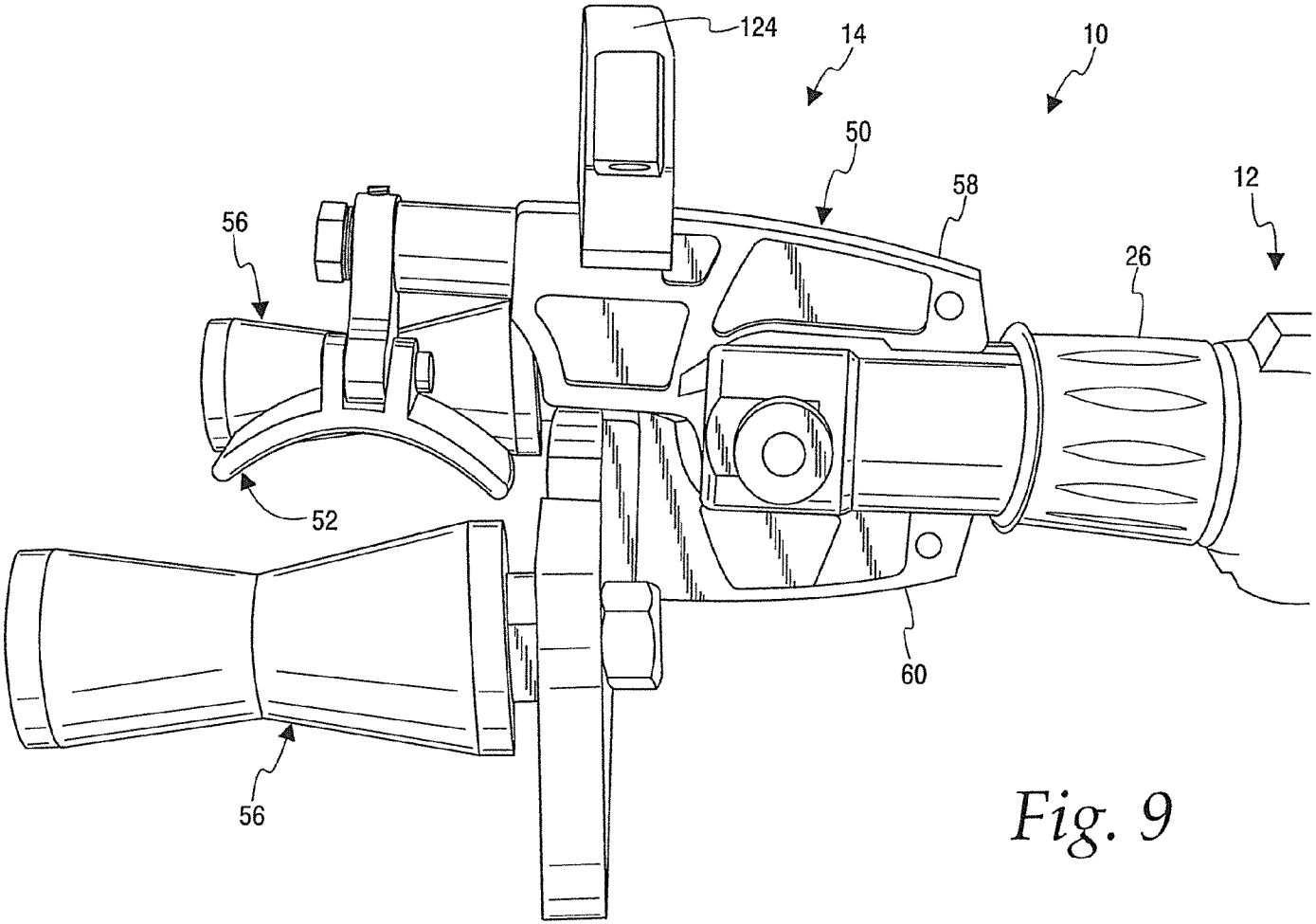
FIG. 9 is a partial perspective view of the cable bending tool with the jaw assembly in the actuated position.

In the neutral position, as shown in FIG. 8, the bending shoe 52 is spaced a select distance from a line formed between the rollers 56. When the operating switch 24 is actuated to extend the drive element 40, from the position shown in FIG. 6 to the position shown in FIG. 7, the rollers 46 act on the jaw near ends 64 and 74 to move them apart in a scissoring action to the actuated position shown in FIG. 9. In the actuated position, the bending shoe 52 is spaced from the line formed between the rollers 56 a distance less than the distance in the neutral position of FIG. 8. In use, a cable C is positioned below the bending shoe 52 and resting atop the rollers 56, as shown in FIG. 2. Driving the jaw assembly 50 from the neutral position to the actuator position forms a bend in the cable C.

The rollers 56 can be adjusted to a position most appropriate for the cable that is to be bent. There are multiple positions that the rollers can be placed in, as discussed above. For example, the rollers may advantageously be placed in openings D and H for a 1,000 MCM cable size, positions C and G for a 750 MCM cable size, and positions B and F for a 500 MCM cable size. The openings A and F can be used for 500 MCM to 100 MCM cable size. Also, the rollers do not have to be positioned equally apart to achieve the proper bend and could be placed, for example, in openings A and G for cable size less than 500 MCM.

In use, the cable C is positioned between the rollers 56 and the bending shoe 52 at the center of where the radius is to begin. The jaw assembly 50 is actuated under battery power to the actuated position to begin the bend. The tool 10 can be stopped at any time during the operation. This operation is repeated to work the cable to the proper bend rating is by moving the bending jaw assembly 50 in 3" to 6" increments down the cable and advancing the jaw assembly 50 to the actuated position to appropriately bend the cable.

Thus, in accordance with the invention, a battery powered cable bending tool 10 comprises a portable, handheld unit which is battery operated to operate in small spaces and allow ease of operation under power provided by the electromechanical drive using battery power.

More particularly, a portable drive housing 12 includes a handle 16 selectively receiving a removable battery 18 and enclosing an electromechanical drive having a power drive element 40 extending from the housing 12. A jaw assembly 50 is secured to the housing 12 proximate the drive element 40 and comprises a first jaw 58 and a second jaw 60 hingedly connected to one another at a hinge connection 80 and having near ends 64 and 74 engaging the drive element 40. The drive element 40 is selectively operated to cause distal ends 66 and 76 of the jaws 58 and 60, respectively, to move between a neutral position, see FIG. 4, and an actuated position, see FIG. 5. A bending shoe 52 is secured to the distal end 66 of the first jaw 58. An arm 54 is secured to the distal end 76 of the second jaw 60. A pair of rollers 56 is operatively secured to the arm 54 on opposite sides of the second jaw 60. The rollers 56 support a cable C, in use, with the bending shoe 52 on an opposite side of the cable C. In the neutral position, the bending shoe 52 is spaced a first distance from a line formed between the rollers 56, see FIG. 8, and in the actuated position, see FIG. 9, the bending shoe is spaced a second distance, less than the first distance, from the line formed between the rollers 56 to bend the cable C.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a few embodiments have been described in detail above, other modifications are possible. Other embodiments may be within the scope of the following claims.

The invention claimed is:

1. A powered cable bending tool comprising:

a portable drive housing including a handle and having a powered drive element;

a jaw assembly secured to the housing and comprising first and second jaws hingedly connected to one another, whereby the drive element is selectively operated to cause the first and second jaws to move between a neutral and an actuated position;

a bending shoe secured to a distal end of the first jaw;

an arm secured to a distal end of the second jaw and extending transversely to a path of movement of the jaws; and first and second rollers operatively secured to the arm on opposite sides of the second jaw, the rollers for supporting a cable, in use, with the bending shoe on an opposite side of the cable, whereby in the neutral position the bending shoe is spaced a first distance from a line formed between the rollers and in the actuated position the bending shoe is spaced a second distance, less than the first distance, from the line formed between the rollers to bend the cable.

2. The powered cable bending tool of claim 1 comprising opposite legs extending from a distal end of the housing and the powered drive element comprises a ram moveable in a path between the legs.

3. The powered cable bending tool of claim 2 wherein the ram supports rollers.

4. The powered cable bending tool of claim 1 wherein the housing selectively receives a battery for powering the powered drive element.

5. The powered cable bending tool of claim 1 wherein the jaw assembly is positioned between the legs and a lug passes through openings in distal ends of the legs and a hinge opening of the jaw assembly to secure the jaw assembly to the housing.

6. The powered cable bending tool of claim 1 wherein the bending shoe comprises a concave plate.

7. The powered cable bending tool of claim 1 wherein the rollers have threaded shafts for selectively securing the rollers to the arm.

8. The powered cable bending tool of claim 7 wherein the arm includes a plurality of spaced openings on each of the opposite sides of the second jaw for selectively receiving the rollers according to a size and bend radius of a cable to be bent.

9. The powered cable bending tool of claim 1 wherein a handle is secured to a top edge of the first jaw.

10. The powered cable bending tool of claim 1 wherein the jaw assembly comprises a spring operatively connected to the first and the second jaws to bias the jaw assembly to the neutral position.

11. A battery powered cable bending tool comprising:

a portable drive housing including a handle selectively receiving a removable battery and enclosing an electromechanical drive having a powered drive element extending from the housing;

a jaw assembly secured to the housing proximate the drive element and comprising first and second jaws hingedly connected to one another and having near ends engaging the drive element, whereby the drive element is selectively operated to cause distal ends of the first and second jaws to move between a neutral and an actuated position;

a bending shoe secured to the distal end of the first jaw;

an arm secured to the distal end of the second jaw and extending transversely to a path of movement of the jaws; and first and second rollers operatively secured to the arm on opposite sides of the second jaw, the rollers for supporting a cable, in use, with the bending shoe on an opposite side of the cable, whereby in the neutral position the bending shoe is spaced a first distance from a line formed between the rollers and in the actuated position the bending shoe is spaced a second distance, less than the first distance, from the line formed between the rollers to bend the cable.

12. The powered cable bending tool of claim 11 comprising opposite legs extending from a distal end of the housing and the powered drive element comprises a ram moveable in a path between the legs.

13. The powered cable bending tool of claim 12 wherein the ram supports rollers.

14. The powered cable bending tool of claim 11 wherein the battery comprises a rechargeable battery for powering the electromechanical drive.

15. The powered cable bending tool of claim 11 wherein the jaw assembly is positioned between the legs and a lug passes through openings in distal ends of the legs and a hinge opening of the jaw assembly to secure the jaw assembly to the housing.

16. The powered cable bending tool of claim 11 wherein the bending shoe comprises a concave plate.

17. The powered cable bending tool of claim 11 wherein the rollers have threaded shafts for selectively securing the rollers to the arm.

18. The powered cable bending tool of claim 17 wherein the arm includes a plurality of spaced openings on each of the opposite sides of the second jaw for selectively receiving the rollers according to a size and bend radius of a cable to be bent.

19. The powered cable bending tool of claim 11 wherein a handle is secured to a top edge of the first jaw.

20. The powered cable bending tool of claim 11 wherein the jaw assembly comprises a spring operatively connected to the first and the second jaws to bias the jaw assembly to the neutral position.

* * * * *